US006008440A

United States Patent [19]

Yamada

[11] Patent Number: 6,008,440

[45] Date of Patent: Dec. 28, 1999

[54] SILENT STRINGED MUSICAL INSTRUMENT HAVING BODY WITH VISCOELASTIC LAYER FOR DAMPING VIBRATIONS

[75] Inventor: Toshiya Yamada, Shizuoka, Japan

[73] Assignee: Yamaha Corporation, Japan

[21] Appl. No.: 08/959,563

[22] Filed: Oct. 28, 1997

[30] Foreign Application Priority Data

Oct. 29, 1996 [JP] Japan ..... 8-286967

[51] Int. Cl.[6] ..... G10D 3/00

[52] U.S. Cl. ..... 84/291

[58] Field of Search ..... 84/274, 275, 291, 84/743

[56] References Cited

U.S. PATENT DOCUMENTS

| | | | |
|---|---|---|---|
| 3,440,919 | 4/1969 | Baker | 84/275 X |
| 3,641,862 | 2/1972 | Rendell | 84/291 |
| 5,170,000 | 12/1992 | Hayashida et al. | 84/291 X |
| 5,191,159 | 3/1993 | Jordan | 84/291 X |
| 5,333,527 | 8/1994 | Janes et al. | 84/291 |
| 5,406,874 | 4/1995 | Witchel | 84/291 |
| 5,537,906 | 7/1996 | Steinberger | 84/291 |

FOREIGN PATENT DOCUMENTS

| | | |
|---|---|---|
| 2533343 | 3/1984 | France . |
| 8701705 | 6/1987 | Germany . |
| 90 14655 | 11/1990 | WIPO . |

*Primary Examiner*—Jeffrey Donels
*Attorney, Agent, or Firm*—Ostrolenk, Faber, Gerb & Soffen, LLP

[57] ABSTRACT

A silent stringed musical instrument includes a wooden body, a neck projecting from one end of the wooden body, peg screws attached to the neck, a tail piece attached to the body, strings stretched between the peg screws and the tail piece, a bridge attached to the body in such a manner as to be held in contact with the strings and an electric system for producing an electric signal from the vibrations of each string; when a player bows the silent stringed musical instrument for playing a tune, the electric system converts the vibrations of each string to the electric signal so as to produce electric sound; however, the body hardly vibrates, because viscoelastic layers are inserted between wooden plates.

11 Claims, 3 Drawing Sheets

SILENT STRINGED MUSICAL INSTRUMENT HAVING BODY WITH VISCOELASTIC LAYER FOR DAMPING VIBRATIONS

FIELD OF THE INVENTION

This invention relates to a silent stringed musical instrument and, more particularly, to a silent stringed musical instrument for producing electric/electronic sounds instead of acoustic sounds.

DESCRIPTION OF THE RELATED ART

A typical example of an electric stringed instrument is an electric guitar. The electric guitar has a solid body, and a neck projects from the solid body. Electromagnetic pickups are attached on the solid body, and strings are stretched over the electromagnetic pickups. When a player plucks the string, the string vibrates, and the electromagnetic pickup converts the vibrations to an electric signal. The electric signal is filtered and amplified, and an electric sound is produced from a speaker.

Another electric stringed musical instrument is known as an electric bowed stringed instrument. The electric bowed stringed instrument has a configuration like an acoustic stringed instrument such as a violin, and electromagnetic pickups are also provided on the body. A player bows and plucks the electric stringed musical instrument, and the electromagnetic pickup converts the vibrations of the string to an electric signal. The electric signal is also filtered and amplified, and a speaker system produces an electric sound from the speaker.

When a player connects a headphone to the amplifier, he hears the performance without disturbance to the neighbor.

An electronic stringed musical instrument is similar in configuration to the electric stringed musical instrument, and the electromagnetic pickup converts the vibrations of the string to an electric signal. A signal processor extracts musical information from the electric signal, and produces musical data codes representative of, for example, pitch of a sound. The music data codes are supplied to a tone generator, and the tone generator produces an audio signal from the music data codes. In this instance, the player selects a timbre, and the tone generator imparts an envelope corresponding to the selected timbre to the audio signal. The audio signal is supplied to a sound system, and the player may hear the electronic sounds through a headphone.

The electric/electronic stringed musical instrument allows the player to control the loudness of the sounds, and the electric/electronic sounds less disturb the neighbor. It is desirable for the player to minimize the acoustic sounds directly produced from the strings. While the player is bowing or plucking the strings, the strings vibrate, and the electric/electronic stringed musical instrument unavoidably produces the acoustic sounds. In this situation, the body has a strong influence on the loudness. If the electric/electronic stringed musical instrument has a solid body, i.e., a body without a resonant chamber, the solid body hardly resonates with the acoustic sound, and is desirable from the aspect. However, the solid body is heavy, and does not allow a player to continue a performance for long time. Moreover, the solid body is quite different in touch from an acoustic bowed stringed instrument, and the player, who is familiar with an acoustic bowed stringed instrument, feels the solid body queer.

The sound chamber of an acoustic stringed instrument such as a violin is a wooden mosaic work, and the wooden mosaic sound chamber is light and gives unique touch to the player. For this reason, it is desirable to use the wooden mosaic sound changer in the electric/electronic stringed instrument. However, the wooden mosaic sound chamber well resonates with the vibrations of strings, and radiates loud sounds. In order to damp the resonant sound, a damping steel plate is inserted into the wooden mosaic sound chamber of a prior art electric/electronic stringed instrument. The damping steel plate is sandwiched between wooden plates. However, the damping steel plate makes the wooden mosaic sound chamber heavy, and the player feels a long performance difficult. Moreover, the damping steel plate increases the production cost of the electric/electronic stringed instrument.

SUMMARY OF THE INVENTION

It is therefore an important object of the present invention to provide a silent stringed instrument, which is light, economical and well damps the acoustic sounds.

To accomplish the object, the present invention proposes to insert a viscoelastic layer into wooden plates.

In accordance with one aspect of the present invention, there is provided a silent stringed musical instrument comprising a body structure including a body of a laminated structure having a plurality of wooden plates and at least one viscoelastic layer adhered to said plurality of wooden plates and at least one string stretched over said body, having at least one end supported by said body and caused to vibrate so as to play a tune by a player.

The silent stringed instrument may further comprise an electric circuit for producing an electric signal from the vibrations of the at least one string.

BRIEF DESCRIPTION OF THE DRAWINGS

The features and advantages of electric/electronic stringed musical instrument will be more clearly understood from the following description taken in conjunction with the accompanying drawings in which.

DESCRIPTION OF THE PREFERRED EMBODIMENTS

First Embodiment

Figure 1:
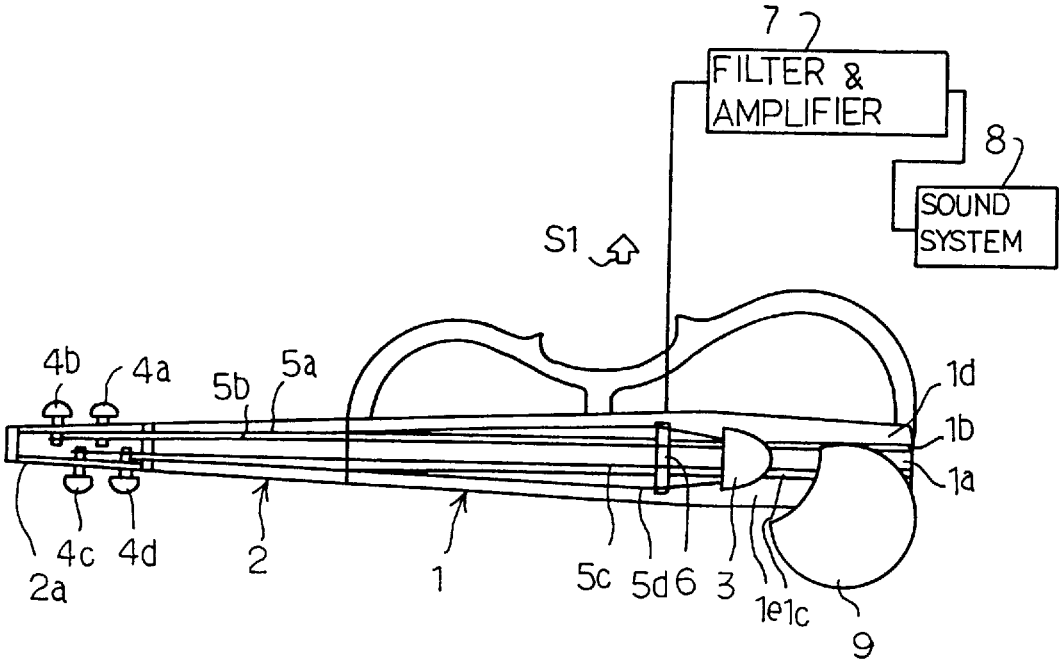
FIG. 1 is a plan view showing an electric violin according to the present invention.
Figure 2:
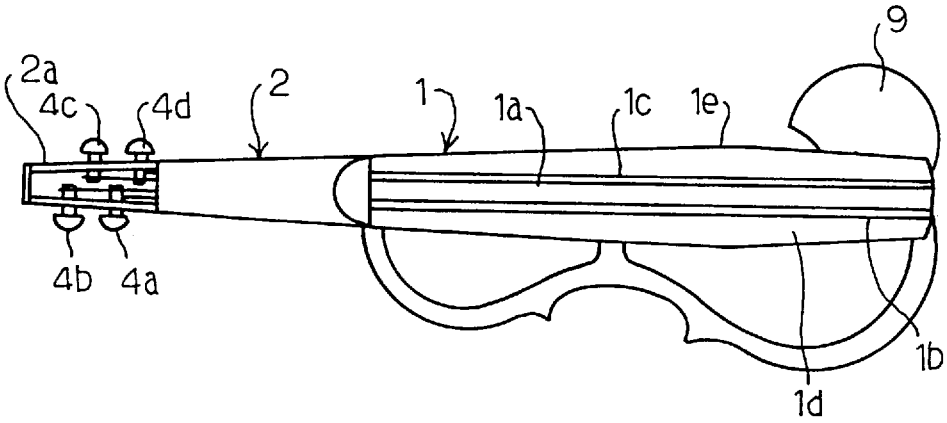
FIG. 2 is a bottom view showing the electric violin.

Referring to FIGS. 1 and 2 of the drawings, a silent electric violin embodying the present invention comprises a body 1, a neck 2 and a tail piece 3. The neck 2 projects from the body 1, and has a box portion 2*a* at the leading end thereof. Peg screws 4*a*, 4*b*, 4*c* and 4*d* are rotatably supported by the box portion 2*a*, and the leading end portions of the peg screws 4*a* to 4*d* project into the inner space of the box portion 2*a*. The tail piece 3 is fixed to the body 1, and is spaced from the box portion 2*a* and, accordingly, the peg screws 4*a* to 4*d*.

The silent electric violin further comprises strings 5*a*, 5*b*, 5*c* and 5*d* and a bridge 6. The bridge 6 is attached to the body 2, and the strings 5*a* to 5*d* are stretched between the tail piece 3 and the peg screws 4*a* to 4*d*. The peg screws 4*a* to 4*d* wind up the strings 5*a* to 5*d*, respectively, so as to impart tension to the strings 5*a* to 5*d*. Vibrations of each string 5*a*/5*b*/5*c*/5*d* are propagated to the bridge 6, and a suitable means such as a piezoelectric element converts the vibrations of the bridge 6 to an electric signal S1. The electric signal S1 is supplied to a filter/amplifier 7, and, thereafter, to a sound system 8. The sound system 8 produces electric sounds from the electric signal S1. The sound system 8 may include a headphone.

The body 1 is not expected to resonate with the vibrations of the strings 5*a* to 5*d*, and is equivalent to a half of the sound chamber of an acoustic violin. For this reason, the silent electric violin further comprises a chin pad 9 attached to the body 1. The chin pad 9 sidewardly projects from the body 1, and a player rests his chin on the pad 9 during the performance.

Figure 3:
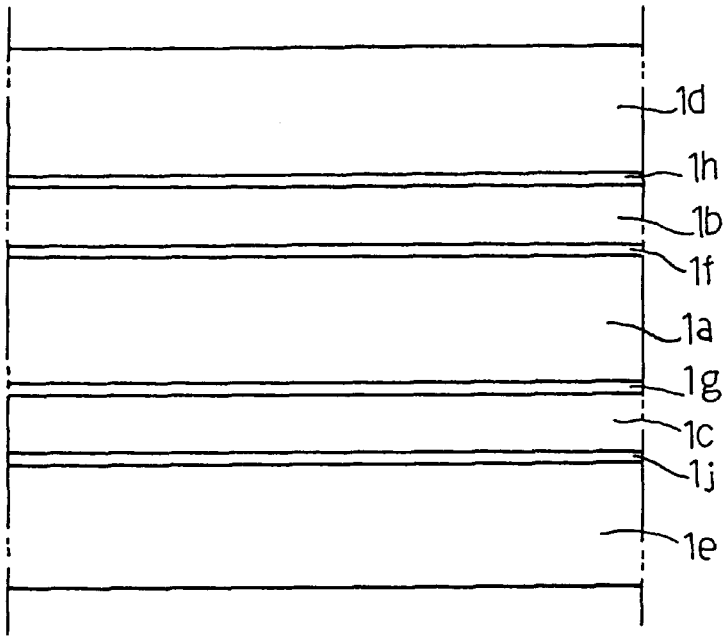
FIG. 3 is a plan view showing a laminated structure of a body of the electric violin.

The body 1 has a laminated structure as shown in FIG. 3. The body 1 includes a base wooden plate 1*a*, intermediate wooden plates 1*b*/1*c* on both sides of the base wooden plate 1*a*, outer wooden plates 1*d*/1*e* on outer sides of the intermediate wooden plates 1*b*/1*c* and viscoelastic layers 1*f*/1*g*/1*h*/1*j*. The viscoelastic layers 1*f* to 1*j* are adhesive, and are inserted between the base wooden plate 1*a* and the intermediate wooden plates 1*b*/1*c* and between the intermediate wooden plates 1*b*/1*c* and the outer wooden plates 1*d*/1*e*. For this reason, the intermediate wooden plates 1*b*/1*c* are bonded to the side surfaces of the base wooden plate 1*a*, and the outer wooden plates 1*d*/1*e* are bonded to the side surfaces of the intermediate wooden plates 1*b*/1*c*, respectively.

The viscoelastic layer 1*f*/1*g*/1*h*/1*j* is formed of viscoelastic compound. The viscoelastic compound is spread over a released sheet, and is adhered to a side surface of the wooden plate. The released sheet is separated from the viscoelastic compound layer, and the viscoelastic compound layer is left on the side surface of the wooden plate. Otherwise, a pressure sensitive double coated sheet is used for the laminated structure. The viscoelastic compound is spread over both surfaces of a base sheet. One of the viscoelastic compound layers is adhered to one of the wooden plates, and another wood plate is adhered to the other viscoelastic compound layer without separation of the base sheet.

The viscoelastic compound is acrylic compound or gum, and the base sheet is selected from the group consisting of cloth, non-woven fabric, paper, synthetic resin sheet and rubber sheet. The acrylic compound is desirable in view of durability. The pressure sensitive double coated sheet is manufactured by Sumitomo-3M Corporation Ltd. As "F9469PC". Acrylic compound is used in F9469PC, and does not lose the resiliency for long time. The viscoelastic compound is large in viscous resistance, and has viscosity like fluid and resiliency like a spring.

When a violinist bows the silent electric violin, the strings 5*a* to 5*d* vibrate, and the vibrations are propagated through the bridge 6 to the body 1. The vibrations of the bridge 6 are picked up, and the electric signal S1 is supplied through the filter/amplifier 7 to the sound system 8. The vibrations are spread over the body 1, and are propagated from the base wooden plate 1*a* through the intermediate wooden plates 1*b*/1*c* to the outer wooden plates 1*d*/1*e*. The base wooden plate 1*a*, the intermediate wooden plates 1*b*/1*c* and the outer wooden plates 1*d*/1*e* respectively vibrate. The viscoelastic compound layers 1*f* to 1*j* are slowly deformed without constraint. However, the viscoelastic compound layers 1*f* to 1*j* are constraint in the laminated structure. For this reason, the viscoelastic compound layers 1*f* to 1*j* forcibly repeat the deformation due to the vibrations. Then, internal friction takes place in the viscoelastic layers 1*f* to 1*j*, and the vibrations are converted to thermal energy. In other words, the viscoelastic layers 1*f* to 1*j* have large vibration damping characteristics, and the body 1 radiates little noise. The viscoelastic compound layers are light and economical. For this reason, the viscoelastic layers 1*f* to 1*j* does not increase the production cost of the silent electric violin, and allows a player to play a tune on the silent electric violin for long time.

In this instance, the body 1, the neck 2, the peg screws 4*a* to 4*d* and the tail piece 3 as a whole constitute a body structure. The vibration-to-electric signal converter such as, for example, piezoelectric elements and the filter/amplifier circuit form in combination an electric system.

As will be understood from the foregoing description, the viscoelastic layers effectively damp the vibrations propagated to the body of the electric violin, and the body mostly formed of wood is light and economical. The player hears the electric sounds through the sound system, and enjoys a performance without disturbance to the neighbor. Thus, the electric violin according to the present invention is a silent stringed musical instrument.

Second Embodiment

Figure 4:
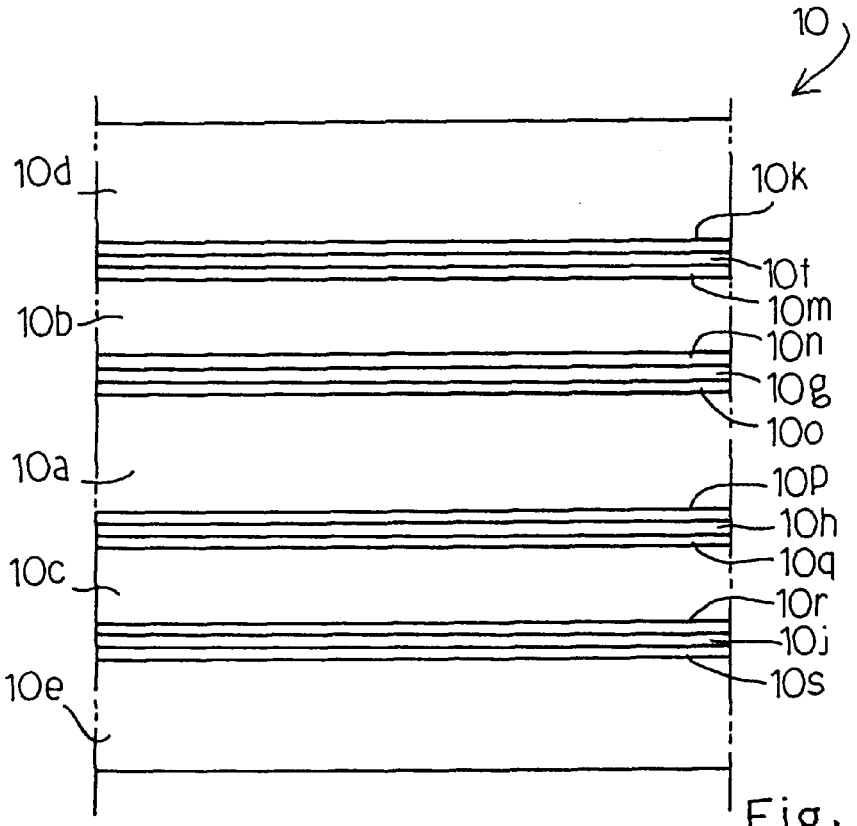
FIG. 4 is a plan view showing a laminated structure of a body of another electric violin according to the present invention.

FIG. 4 illustrates the laminated structure of a body 10 forming a part of another silent electric violin embodying the present invention. The other parts and strings of the silent electric violin are similar to those of the first embodiment, and no further description is incorporated hereinbelow.

Cellular layers are inserted into the laminated structure of the body 10. In detail, the laminated structure also includes a base wooden plate 10*a*, intermediate wooden plates 10*b*/10*c* on both sides of the base wooden plate 10*a* and outer wooden plates 10*d*/10*e* on the outer sides of the intermediate wooden plates 10*b*/10*c* as similar to the laminated structure of the first embodiment. The laminated structure further includes cellular layers 10*f*/10*g*/10*h*/10*j* provided between the wooden plates 10*d*/10*b*, 10*b*/10*a*, 10*a*/10*c* and 10*c*/10*e*, respectively, and viscoelastic layers 10*k*/10*m*/10*n*/10*o*/10*p*/10*q*/10*r*/10*s* between the cellular layers 10*f* to 10*j* and the wooden plates 10*k* to 10*s*. In this instance, the viscoelastic layers 10*k* to 10*s* are formed from the pressure sensitive double coated sheet, and bond the cellular layers 10*f* to 10*j* to the wooden plates 10*a* to 10*e*. In the assembling work, the viscoelastic layers 10*k* to 10*s* are adhered to both sides of the cellular layers 10*f* to 10*j*, and, thereafter, the other surfaces of the viscoelastic layers 10*k* to 10*s* are adhered to the wooden plates 10*a* to 10*e*.

Although acrylic foam, urethane foam and rubber foam are available for the cellular layers 10*f* to 10*j*, the acrylic foam is preferable in view of the strength and the durability. The expansion ratio of the cellular layer ranges from 1.3 to 1.5, and the density falls within 0.65 g/cm$^3$ to 0.72 g/cm$^3$. The laminated structure of the cellular layer and the viscoelastic layers is manufactured by Sumitomo-3M Corporation Ltd., and the product code is "Y-4914". The laminated structure "Y4914" has a cellular layer of acrylic resin form and viscoelastic layers of acrylic compound adhered to both side surfaces of the cellular layer, and the total thickness is 0.25 millimeter.

The viscoelastic layers behaves as similar to those of the first embodiment. The cellular layers 10*f* to 10*j* have large resiliency, and prevent the wooden plates from peeling. Moreover, the cellular layers 10*f* to 10*j* enhances the vibration damping characteristics, and the acoustic sound is further reduced.

Third Embodiment

Figure 5:
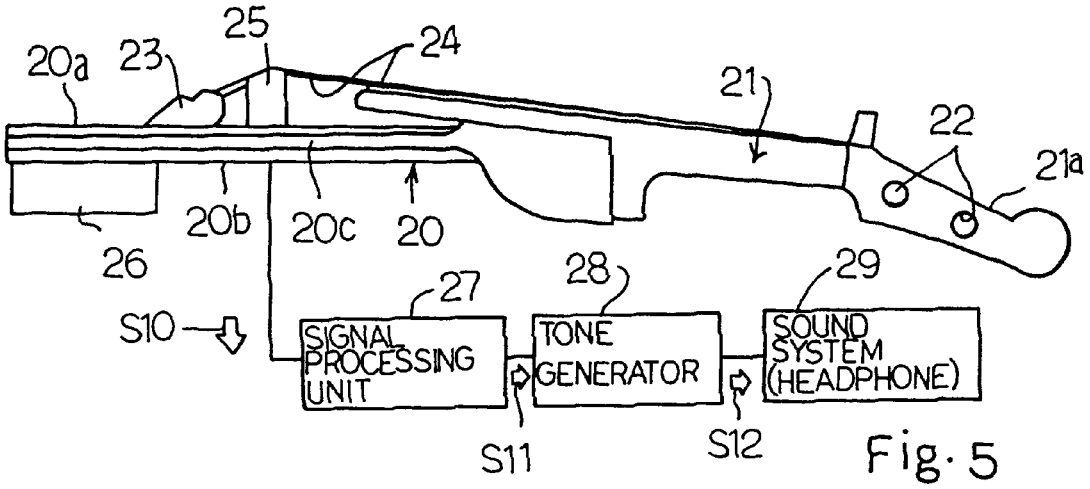
FIG. 5 is a side view showing the structure of an electronic violin according to the present invention.

FIG. 5 illustrates an electronic stringed musical instrument embodying the present invention. The electronic string musical instrument largely comprises a body 20, a neck 21 projecting from the body 20, peg screws 22 screwed into a box portion 21*a* of the neck 21, a tail piece 23 attached to the body 20, strings 24 stretched between the peg screws 22 and the tail piece 23, a bridge 25 fixed to the body and a chin pad 26. The neck 21, the peg screws 22, the tail piece 23, the strings 24, the bridge 25 and the chin pad 26 are similar to those of the first embodiment, and no description is incorporated hereinbelow.

Figure 6:
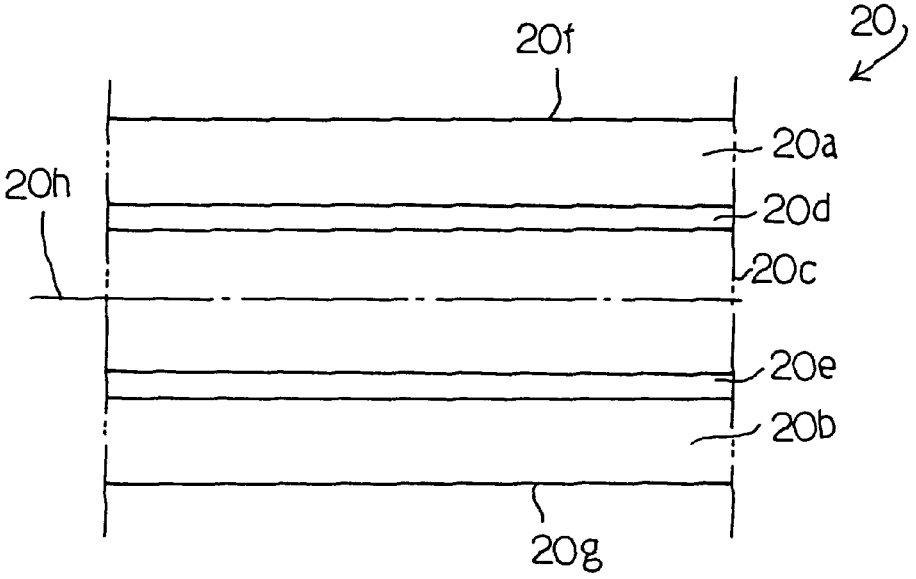
FIG. 6 is a side view showing a laminated structure of a body of the electronic violin.

The body 20 also has a laminated structure as shown in FIG. 6. Upper/lower wooden plates 20*a*/20*b* are laminated on a base wooden plate 20*c*, and pressure sensitive double coated layers 20*d*/20*e* adhere the upper/lower wooden plates 20*a*/20*b* to the upper/lower surfaces of the base wooden plate 20*c*. In this instance, F9469PC or Y-4914 is used for the pressure sensitive double coated layers 20*d*/20*e*. The pressure sensitive double coated layers 20*d*/20*e* or viscoelastic layers behave as similar to those of the first embodiment, and effectively damp the vibrations propagated from the strings 24 to the body 20. When the viscoelastic layers 20*d*/20*e* are close to the upper and lower surfaces 20*f*/20*g* of the laminated structure, the viscoelastic layers 20*d*/20*e*are effective against: high-frequency vibrations. On the other hand, the viscoelastic layers 20*d*/20*e*are close to the center line 20*h*, the viscoelastic layers 20*d*/20*e* are effective against low-frequency vibrations. The cellular layers may be inserted as similar to the second embodiment.

Turning back to FIG. 5 of the drawings, the silent stringed musical instrument further comprises a signal processing unit 27, a tone generator 28 and a sound system 29. An analog signal S10 is supplied from the vibration pickup means such as, for example, piezoelectric elements to the signal processing unit 27. The signal processing unit 27 extracts pieces of music data information from the analog signal S10, and produces digital music signals S11 representative of electronic sounds to be produced. The digital music signals S11 are supplied to the tone generator 28, and the tone generator 28 imparts an envelop to a periodical signal on the basis of the digital music signals for producing an audio signal S12. The audio signal S12 is supplied to the sound system 29, and produces electronic sounds. A player may hear the electronic sounds through a headphone. The vibration pickup means, the signal processing unit 27 and the tone generator 28 as a whole constitute an electric system.

Modifications

Although the particular embodiments of the present invention have been shown and described, it will be obvious to those skilled in the art that various changes and modifications may be made without departing from the spirit and scope of the present invention.

For example, the pressure sensitive double coated sheet may have a cellular layer serving as the base sheet.

The body according to the present invention may be used in a stringed instrument having strings plucked by a player such as, for example, an electric guitar.

The body according to the present invention is applicable to any silent stringed musical instrument such as, for example, viola and cello.

A body may be a compromise between the first/second embodiment and the third embodiment. Namely, the wooden pieces are arranged in rows and columns, and the viscoelastic layers are inserted between the wooden pieces like a lattice.

The wooden plates may be previously coated with thin synthetic resin film such as polyurethane primer film. The synthetic resin film enhances the adhesion between the wooden plates and the viscoelastic layers.

In the above embodiments, the viscoelastic layers are provided in all the boundaries between the wooden plates. However, the viscoelastic layers may be selectively inserted into the boundaries.

If a player do not care the touch of the body, the wooden layers may be selectively replaced with a synthetic resin layer.

What is claimed is:

1. A silent stringed musical instrument comprising a body structure including a body of laminated structure having a plurality of wooden plates and at least one viscoelastic layer adhered to said plurality of wooden plates and maintaining resiliency after said at least one viscoelastic layer is adhered to said plurality of wooden plates, and at least one string stretched over said body, having at least one end supported by said body and caused to vibrate so as to play a tune by a player.

2. The silent stringed instrument as set forth in claim 1, further comprising an electric system connected to said body structure for producing an electric signal from the vibrations of said at least one string.

3. The silent stringed instrument as set forth in claim 2, further comprising a sound system connected to said electric system and responsive to said electric signal for producing a sound.

4. The silent stringed instrument as set forth in claim 1, in which said plurality of wooden plates are laminated in a direction of thickness of said body.

5. The silent stringed instrument as set forth in claim 1, in which said plurality of wooden plates are selectively replaced with a synthetic resin plate.

6. A silent stringed instrument comprising a body structure including a body of a laminated structure having a plurality of wooden plates and at least one viscoelastic layer adhered to said plurality of wooden plates, and at least one string stretched over said body having at least one end supported by said body and caused to vibrate so as to play a tune by a player, said plurality of wooden plates being arranged in a transverse direction perpendicular to a direction in which said at least one string extends.

7. A silent stringed musical instrument comprising:

a body structure including a body of a laminated structure having a plurality of wooden plates and at least one viscoelastic layer adhered to said plurality of wooden plates and formed of viscoelastic material selected from the group consisting of acrylic compound and gum compound, and at least one string stretched over said body, having at least one end supported by said body and caused to vibrate so as to play a tune by a player.

8. A silent stringed instrument comprising a body structure including a body of a laminated structure having a plurality of wooden plates and at least one viscoelastic layer adhered to said plurality of wooden plates, said viscoelastic layer being formed from a pressure sensitive double coated sheet having a base layer and viscoelastic layers spread over both surfaces of said base layer, and at least one string stretched over said body, having at least one end supported by said body and caused to vibrate so as to play a tune by a player.

9. A silent stringed instrument comprising a body structure including a body of a laminated structure having a plurality of wooden plates and at least one viscoelastic layer adhered to said plurality of wooden plates, said at least one viscoelastic layer being divided into two viscoelastic sub-layers, said laminated structure further having a cellular layer inserted between said two viscoelastic sub-layers, and at least one string stretched over said body, having at least one end supported by said body and caused to vibrate so as to play a tune by a player.

10. The silent stringed instrument as set forth in claim 9, in which said cellular layer is formed of the material selected from the group consisting of acrylic compound, urethane compound and rubber compound.

11. A silent stringed instrument comprising a body having a plurality of wooden plates and viscoelastic layers of acrylic compound inserted between said plurality of wooden plates so that said plurality of wooden plates and said viscoelastic layers are integrated into a laminated structure, a neck projecting from one end of said body, a plurality of peg screws attached to a leading end portion of said neck, a tail piece attached to said body, a plurality of strings stretched between said peg screws and said tail piece, a bridge attached to said body under said plurality of strings in such a manner that vibrations of each string is propagated thereto, an electric system connected to said bridge and producing an electric signal from said vibrations of each string, and a sound system supplied with said electric signal so as to produce a sound.

* * * * *